US008101876B2

(12) United States Patent
Andreasen et al.

(10) Patent No.: US 8,101,876 B2
(45) Date of Patent: Jan. 24, 2012

(54) ELECTRO-MECHANICAL PULSE GENERATOR

(75) Inventors: Jørgen Andreasen, Næstved (DK); Søren Ravnkilde, Ballerup (DK); Peter Gorm Larsen, Holmegård (DK)

(73) Assignee: Sonion APS, Roskilde (DK)

( * ) Notice: Subject to any disclaimer, the term of this patent is extended or adjusted under 35 U.S.C. 154(b) by 358 days.

(21) Appl. No.: 12/427,371

(22) Filed: Apr. 21, 2009

(65) Prior Publication Data

US 2009/0260959 A1 Oct. 22, 2009

Related U.S. Application Data

(60) Provisional application No. 61/125,092, filed on Apr. 22, 2008.

(51) Int. Cl.
*H01H 19/11* (2006.01)

(52) U.S. Cl. ..... 200/11 R; 200/565

(58) Field of Classification Search ..... 200/11 R, 200/11 TW, 564, 565, 569
See application file for complete search history.

(56) References Cited

U.S. PATENT DOCUMENTS

| | | | | |
|---|---|---|---|---|
| 4,209,976 A | | 7/1980 | Flumm | 368/187 |
| 4,455,458 A | * | 6/1984 | Oyama | 200/1 B |
| 5,194,704 A | * | 3/1993 | Michalski et al. | 200/11 R |
| 5,380,965 A | | 1/1995 | Møller | 200/11 R |
| 6,153,843 A | * | 11/2000 | Date et al. | 200/339 |
| 6,943,308 B2 | | 9/2005 | Ravnkilde et al. | 200/200 |
| 6,972,306 B2 | | 12/2005 | Dotson et al. | 524/108 |
| 6,972,386 B1 | * | 12/2005 | McSwiggen | 200/11 R |
| 6,998,553 B2 | | 2/2006 | Hisamune et al. | 200/336 |
| 7,423,230 B2 | | 9/2008 | Yoritsune et al. | 500/565 |
| 7,728,237 B2 | * | 6/2010 | Pedersen et al. | 200/11 R |
| 2006/0071489 A1 | | 4/2006 | Bricaud | 294/67.3 |

FOREIGN PATENT DOCUMENTS

| | | |
|---|---|---|
| DE | 3025514 | 1/1982 |
| DE | 102006019696 | 10/2007 |
| DK | 168258 | 2/1992 |
| JP | 9245571 | 9/1997 |
| WO | WO 03043040 A2 | 5/2003 |

* cited by examiner

*Primary Examiner* — Xuong Chung Trans

(74) *Attorney, Agent, or Firm* — Nixon Peabody LLP

(57) ABSTRACT

An electromechanical pulse generator and a method of generating electrical pulses are disclosed. The electromechanical pulse generator comprises very few parts and includes an effective mechanism to prevent contact rebound. An upper, user-actuable and rotatable part has a surface with a plurality of projections. A lower part has an electrical conductor with a displaceable resilient contact portion biased against the projections and two electrical contacts positioned, in the plane of rotation, on either side of the displaceable contact portion.

12 Claims, 3 Drawing Sheets

ELECTRO-MECHANICAL PULSE GENERATOR

CROSS REFERENCE TO RELATED APPLICATION

This application is related to and claims priority to U.S. Provisional Patent Application Ser. No. 61/125,092 filed Apr. 22, 2008, titled "An Electro-Mechanical Pulse Generator," which is incorporated herein in its entirety

FIELD OF THE INVENTION

The present invention relates to an electromechanical pulse generator and a method of generating electrical pulses. The electromechanical pulse generator comprises very few separate parts and includes an effective mechanism to prevent contact rebound during actuation.

BACKGROUND OF THE INVENTION

A number of different electro-mechanical pulse generators are disclosed in U.S. Pat. No. 5,380,965, U.S. Pat. No. 6,972,306, U.S. Pat. No. 6,943,308, DE 3025514 and DK-A-168,258. Most of these electro-mechanical pulse generators are relatively complicated with a large number of parts and have no self-cleaning properties. The electro-mechanical pulse generator disclosed in DE 3025514 lacks a mechanism to prevent rebound of a displaceable contact portion during its travel between two opposing stationary electrical contacts.

SUMMARY OF THE INVENTION

Thus, it is an object of the invention to provide a simple electro-mechanical pulse generator made of few parts and of a simple construction to allow the electro-mechanical pulse generator to be scaled to a very small size while retaining reliable function across inevitable manufacturing process variations.

It is another object of the invention to provide an electro-mechanical pulse generator that comprises a mechanism to prevent rebound of a displaceable resilient contact portion of the electro-mechanical pulse generator.

According to a first aspect of the present invention, there is provided an electro-mechanical pulse generator comprising a base and a first part. The first part is rotatably mounted relative to the base around an axis of rotation. The first part comprises a surface with a predetermined number of projections extending toward the base. Each projection has a top, and valleys existing between neighboring projections. The base comprises an electrical conductor having a displaceable resilient contact portion and two electrical contacts having a predetermined distance there between. The displaceable resilient contact portion is biased toward the surface of the first part. The electrical contacts extend, along the axis of rotation, at least from a first position occupied by the resilient contact portion when engaging a valley between two neighboring projections and to a second position occupied by the resilient contact portion when engaging a top of a projection. The base comprises a protrusion arranged to contact the displaceable resilient contact portion to prevent rebound thereof.

In the present context, the resiliency of the displaceable resilient contact portion or displaceable portion preferably is a bending capability. Also, preferably the resiliency provided by the displaceable portion is a non-permanent or elastic deformation.

Naturally, both the electrical contacts and the electrical conductor may be resilient, or a part thereof may be provided with resilient properties by providing this part of another material or in suitable dimensions to provide actual resiliency at the forces exerted on the electrical conductor in the present context.

Preferably all projections on the rotatable first part have substantially the same shape and height, but this is not required.

It is an advantage of the invention that rotation of the first part in relation to the base will make the displaceable portion engage and slide along an outer surface of the electrical contacts from the first to the second position, whereby a mutual cleansing of the contact surfaces is obtained.

The protrusion on the base that is configured to prevent rebound of the displaceable portion is preferably arranged proximally to an outer peripheral surface of the base. The base preferably has a disc-shaped or cylindrical outer contour with the protrusion arranged along a circumferential section of the disc-shaped or cylindrical base. The cylindrical base preferably comprises a pie piece, or circle sector cut-out, with a flat bottom surface from which the protrusion projects in a direction along the axis of rotation.

The protrusion may comprise a top section and a pair of inclined surfaces leading down to a surface of the base, for example, a flat bottom surface in the circle sector cut-out. The pair of inclined surfaces are arranged to slidingly engage with the displaceable resilient displaceable portion.

According to a particularly advantageous embodiment of the invention, a distance, along the axis of rotation, between the top of a projection and a top of the protrusion is smaller than a cross-sectional dimension, such as a diameter, of the displaceable portion. This embodiment prevents a formation of an unintentional path through which the resilient displaceable displaceable portion can travel after it has engaged one of the electrical contacts (active electrical contact) and begins to revert towards a neutral or middle location between the two electrical contacts. The absence of such an unintentional path of travel towards an inactive electrical contact effectively prevents rebound effects.

Preferably, the displaceable portion extends outwardly and between the electrical contacts in order to ensure that the displaceable portion will engage these when a projection of the rotating first part moves the displaceable portion in either clock-wise or counter-clock-wise direction toward one of the electrical contacts. The size or extent of the electrically conductive elements ensuring that the displaceable portion remains engaged with the electrical contacts while sliding there along by the rotating projection.

In a preferred embodiment, the projections are positioned, in the plane of the rotation, in a uniform circular pattern around the axis of the rotational movement. In this manner, the projections will all be displaced along the same path, when the first part is actuated or rotated.

In one particular embodiment of the invention, the first part is movable in the axial direction toward the base, such as in a direction along the rotational axis. The base comprises a third electrical contact element positioned, in a plane of the rotational movement, between the two electrical contacts and, along the perpendicular direction, at a third position being further along the perpendicular direction than the second projection. This third position ensures that the displaceable portion is unable to contact this third electrical contact element during normal rotation.

An alternative embodiment that comprises the third electrical contact element is one, wherein one or more projections are higher (measured perpendicularly to the plane of rotation)

than other projections. Thus, the third electrically conducting element may be positioned so as to be contacted by the displaceable portion when traveling over this/these higher projections. In this manner, not only a relative number (the number of projections encountered or engaged) can be detected, but electrical contact between the electrical contact element and the contacting portion will provide information as to the actual or absolute rotational position of the first part in relation to the base.

In one embodiment, the projections are positioned along a predetermined curve in a plane of the rotatable movement. Then, a part of the electrical conductor may be attached or fixed in, or to, the base for example by gluing, welding, or molding with the displaceable portion extending, in the plane, from inside the curve and out thereof. In one embodiment, the curve forms a circle with the displaceable portion extending along a radius of the circle. The displaceable portion may have a size so as to extend beyond the circle in order for the displaceable portion to engage the projections.

The electrical conductor may comprise a U-shaped section with one leg fixed to the base and the other leg comprising the displaceable portion.

Preferably, the two electrical contacts extend, in a direction of a projection toward and out of the top of the projection, parallel to each other. Alternatively, the two electrical contacts may lean toward each other in an inclined angle relative to the plane of rotation.

According to another aspect of the present invention, there is provided a method of generating electrical impulses by actuating an electro-mechanical pulse generator, the method comprising steps of:

(a) providing a first part rotatable in relation to a base around an axis of rotation, the first part being adapted to be user operable and having a surface comprising a number of projections each having a top, (b) providing, in engagement with the base, an electrical conductor having a displaceable resilient contact portion biased toward a surface of the first part, (c) providing, in engagement with the base, two electrical contacts positioned, in the plane of rotation, on opposing sides and adjacent to the displaceable resilient contact portion, (d) rotating the first part in relation to the base in a predetermined direction of rotation so that the displaceable resilient contact portion engages a projection and is displaced, substantially in a plane of the rotation, until the resilient contact portion engages one of the electrical contact(s), (e) after step (d), sliding the displaceable resilient contact portion along a surface of the projection and a surface of the electrical contact, at an angle to the plane of rotation, until the displaceable resilient contact portion reaches the top of the projection, (f) disengaging the contact between the electrical contact and the displaceable resilient contact portion by further rotation of the first part in the predetermined direction of rotation, (g) contacting and preventing movement of the displaceable resilient contact portion in a direction opposite to the predetermined direction of rotation by a protrusion arranged on the base to prevent rebound of the displaceable resilient contact portion, and (h) repeating steps (d) through (g) one or more times.

Preferably, the rotation, in step (d), provides, sequentially, the projections to a rotational position at which they, again sequentially, engage the contact portion.

Steps (d)-(f) describe how a single projection firstly moves the displaceable portion in one direction and subsequently, by the aid of the conductive element, in the opposite direction. Thus, the detecting the number of projections, and thereby the angle of rotation of the first part, may be effected by counting the number of electrical connections between the displaceable portion and the electrical contact in question (active electrical contact). The disengagement in step (f) may be obtained by having the displaceable portion sliding over the top of the engaged projection and down of the other side of the projection. The spring effect or resiliency of the displaceable portion retracts the displaceable portion from its engagement to the electrical contact and forces it to travel towards an unactuated or neutral position preferably in the middle position between the electrical contacts.

According to in step (g), the movement of displaceable resilient displaceable portion in a direction opposite to the predetermined direction of rotation, towards the neutral position, is stopped by the protrusion arranged on the base. The action of the protrusion on the base therefore prevents the displaceable resilient displaceable portion to travel towards and intermittently contact the opposite electrical contact (inactive electrical contact). An action that would have lead to the production of a "false" or rebound electrical pulse on the inactive electrical terminal.

A third aspect of the invention relates to a hearing aid or personal communication device comprising the above-mentioned electro-mechanical pulse generator. In the present context a personal communication device comprises portable and battery operated devices capable of providing personalized sound for a patient or a user. Such a device may comprise a headset, a hearing prostheses, an in-ear monitor, a hearing protection device, a mobile or cellular phone. The hearing prostheses may comprise a Behind-The-Ear (BTE) hearing aid, an In-The-Canal (ITC) hearing aid, a Completely In-the-Canal (CIC) hearing aid, or any other type of hearing aid.

According to this aspect of the invention, a user-operable function of the hearing aid or personal communication device may be controlled by actuating the electro-mechanical pulse generator. The function that is controlled may be sound volume, preset program selection or menu item scrolling in a display menu and/or any other suitable user-operable function. The third electrical contact element and the pushing operation (or the sensing of the higher projections) may also be used to either select a menu item or for changing between features or other elements operated or altered by the rotation of the first part in relation to the base.

In this relation, the user operability may simply mean that the user is able to grab, engage or actuate the first part to provide the rotation. The first part may accordingly comprise a knob with a rugged or granular surface to facilitate user actuation.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

Preferred embodiments of the invention will be described in the following with reference to the accompanying drawings, wherein.

Figure 1:
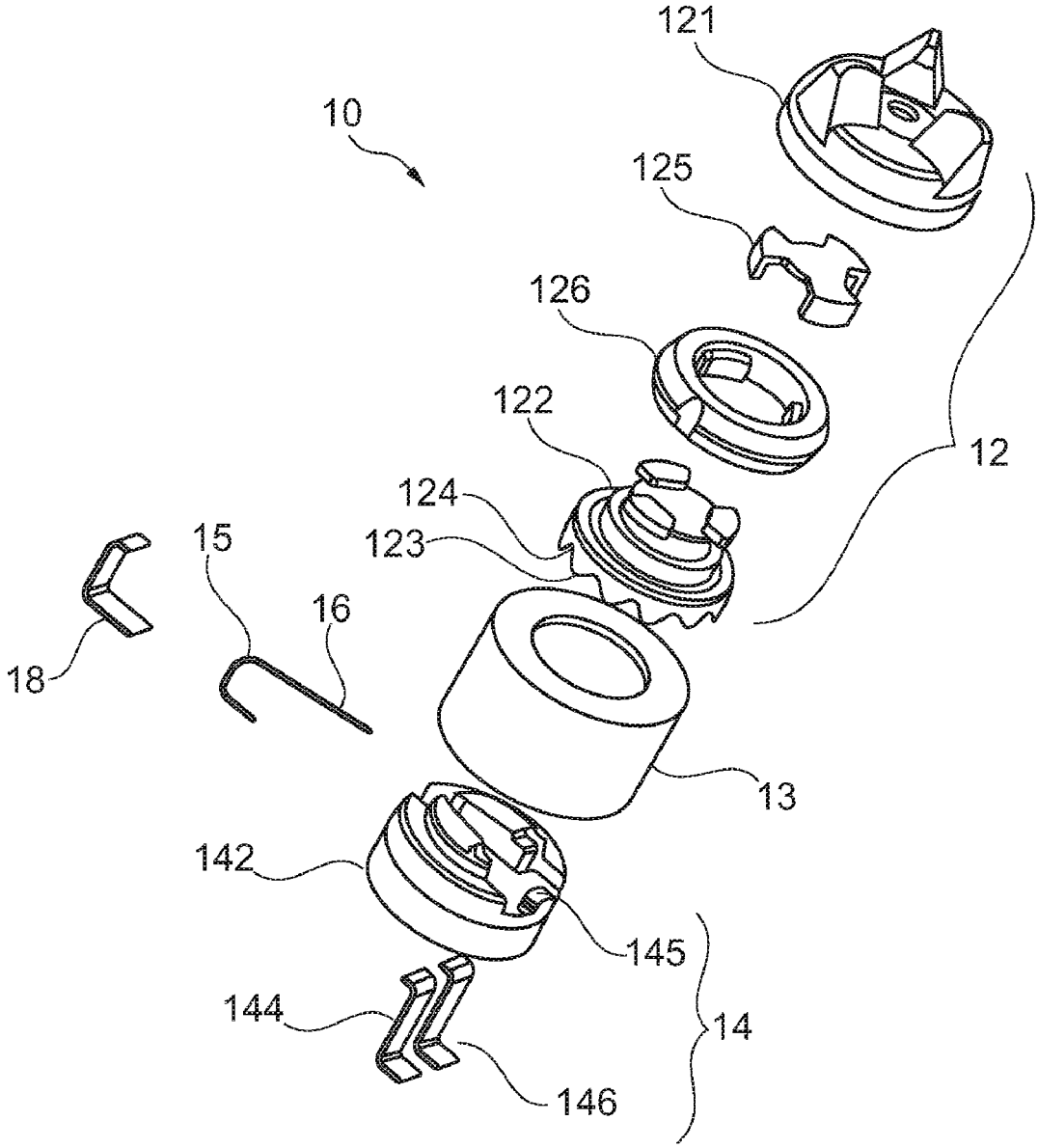
FIG. 1 is an exploded view of a first embodiment of an electromechanical pulse generator in accordance with the invention.
Figure 2A:
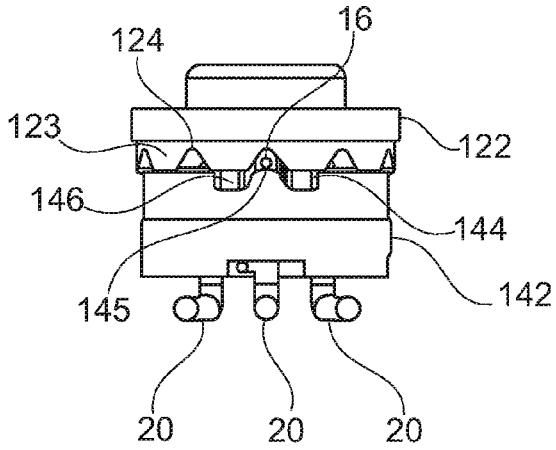
FIGS. 2(*a*) to 2(*f*) illustrate the dynamic operation of the electromechanical pulse generator illustrated in FIG. 1 during rotation.
Figure 2B:
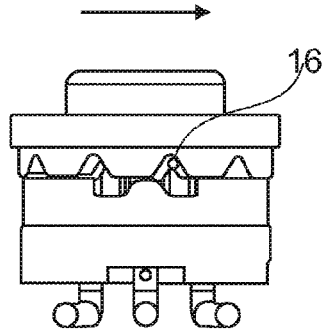
Figure 2C:
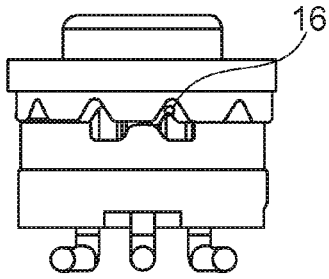
Figure 2D:
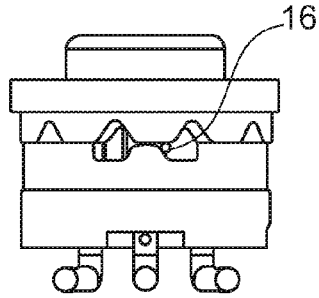
Figure 2E:
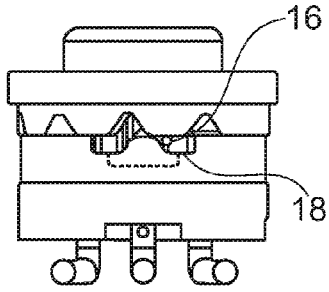
Figure 2F:
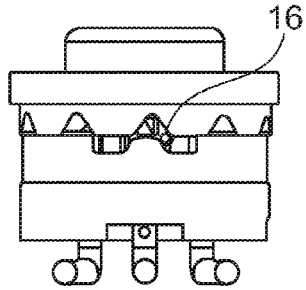

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF PREFERRED EMBODIMENTS

FIG. 1 is an exploded view of an electromechanical pulse generator or pulse generator according to a preferred embodiment of the invention. The pulse generator 10 comprises a first part 12 and a base part 14 placed inside a cylindrical housing 13. The first part 12 comprises a user actuatable knob 121, preferably having a corrugated outer surface for improved grip and facilitating user manipulation.

This user actuatable knob 121 is attached to another element 122 which, on a lower surface, comprises a number of projections 123 and valleys 124 positioned between neighbouring projections 123. The number of projections may vary according to requirements of any specific application, but may be 10-20 projections, such as 12-15 projections The projections 123 extend radially toward a centre of the lower surface of element 122 to form a substantially circular pattern in order to facilitate rotation. This will be explained in further detail below.

Depending on the dimensions of the pulse generator, more or less projections may be used. A miniature pulse generator suited for mobile phones or hearing aids may have an outer housing diameter between 2.5 and 5.0 mm.

The base 14 comprises a base element 142 and two electrically conducting terminals 144 and 146 attached thereto. The base element 142 comprises a pie-shaped cut-out or track bounded at its sides by the electrical contacts or terminals 144 and 146.

In addition, a displaceable resilient contact portion 16 or displaceable portion 16, in the form of a leg of U-shaped electrical conductor 15 is provided—in the pie-shaped track. The U-shaped electrical conductor 15 is fixed at a bent end portion to the base 142 while the other end thereof comprises the displaceable portion 16 and is unsupported and freely displaceable. This displaceable portion 16 is oriented so as to point slightly away from the base 142. The reason why will become clear further below. Thus, the displaceable electrical conductor portion 16 is resiliently displaceable in a first plane substantially parallel to the plane of rotational movement of the first part 12. The displaceable portion 16 is additionally displaceable in second, substantially orthogonal, axial direction of the electro-mechanical pulse generator 10. In an assembled pulse generator 10, rotation of the first part 12 in relation to the base 14 will rotate the projections 123. The displaceable portion 16 extends outward toward and past a circle formed by the projections 123 and will be biased against the projections 123 or valleys 124 due to the spring effect of the U-shaped electrical conductor 15 and the slight bending away from the base element 142. The base element 142 additionally comprises a protrusion 145 arranged proximally to an outer peripheral surface of the (cylindrical or disc shaped) base 142 and between the electrical contacts 144 and 146. The protrusion 145 is configured to contact the displaceable portion 16 to prevent rebound thereof against an inactive electrical contact, i.e. contact 144 or 146 as the case may be, during actuation of the pulse generator 10. The protrusion 145 is preferably provided as an integral part of the base element 142 for example by manufacturing the base element as an injection molded thermoplastic item.

Naturally, spring constants of the spring formed by the displaceable leg of the U-shaped electrical conductor 15 may be designed with different values in the two above-mentioned substantially orthogonal planes of displacement. This may be accomplished by selecting a non-circular cross section of the displaceable portion 16. Thus, an elongate cross section will facilitate a relatively smaller spring constant in the direction of the shorter dimension compared to the wider dimension. Also, the spring constants may be adjusted by an appropriate selection of the material or length of the displaceable leg of the U-shaped electrical conductor 15.

FIGS. 2(*a*) to 2(*e*) illustrate the dynamic operation of the pulse generator during clock-wise actuation, as indicated by the arrow above FIG. 2(*b*) during rotation of the control knob 121. FIG. 2(*a*) illustrates the displaceable portion 16 in a neutral or centre position and engaging a valley 124 of the element 122. The displaceable portion 16 is upwardly biased either by its built-in resiliency or spring force or by a flexible member. In the centre position, the displaceable portion 16 does not engage any of the electrical contacts 144/146.

By manipulating the user actuatable knob 121, the projections 123 will rotate to the right and bring the pulse generator 10 to the position in FIG. 2(*b*), where the displaceable portion 16 engages a side of the projection 123 and is simultaneously forced or displaced in a sideways direction. The sideways displacement continues until the displaceable portion 16 engages the electrical contact 144, which essentially prevents further sideways movement of the displaceable portion 16.

FIG. 2(*c*) illustrates a state where further rotation of the first part 12 forces the displaceable portion 16 downwards in order to accommodate the further rotation. FIG. 2(*d*) and FIG. 2(*e*) show further progressed states where the displaceable portion 16 is forced along the side of the projection 123, in frictional engagement with, and along the electrical contact 144 until the displaceable portion 16 reaches the top of the projection 123.

FIG. 2(*e*) and FIG. 2(*f*) both illustrate states wherein the displaceable portion 16 contacts and slides past the flat top of the projection 123 moving in a direction opposite to the direction of rotation of the knob 121. The displaceable portion 16 is seeking to return towards its centre position due to the spring force (in first plane) acting on the displaceable portion 16. This reverse motion of the displaceable portion 16 firstly leads to disconnect of electrical and physical contact to the electrical contact 144. Subsequently, further reverse movement of the displaceable portion 16 toward the centre position is effectively stopped by the base projection 145 as illustrated in FIG. 2(*f*). The action of the base projection 145 accordingly prevents the displaceable portion 16 from moving towards and contacting the other (inactive) electrical contact 146 which would have generated "false" or rebound electrical pulses on the latter contact.

Finally, further rotation of knob 121 will make the displaceable portion 16 slide along the other side of the projection 123 and into the adjacent valley to return the state of the pulse generator to FIG. 2(*a*).

The sliding of the displaceable portion 16 along the surface of the electrical contact 144 provides an advantageous cleansing of the respective surfaces during contact releasing contamination agents such as oxide layers, sweat and cerumen (hearing aids) or dust and smoke particles.

Thus, continued rotation of the first part 12 in relation to the base 14 in the above direction will be detectable as successive electrical connections and disconnections between the displaceable portion 16 and the electrical contact 144. The angle rotated will be determinable from the number of connections determined. Rotation in the opposite direction will have the displaceable portion 16 to successively engage and disengage the opposing electrical contact 146 instead. Thus, rotation angle and rotation direction are both detectable by a suitable processor electrically connected to the displaceable portion 16 and the electrical contacts 144/146. The processor may comprise a programmed microcontroller, DSP or digital state-machine.

A preferred way sensing or detecting the contact between the displaceable portion 16 and one of the electrical contacts 144/146 comprises applying DC voltage difference between the displaceable portion 16 and each of the electrical contacts 144 and 146. The electrical contacts 144 and 146 may be connected to a DC supply rail through respective pull-up resistors and the displaceable portion 16 to a ground node, or another readily available DC voltage, or vice versa. Thus, detecting which one of the electrical contact that is active and counting the number of the voltage pulses provided on one of the active electrical contact will allow a direction of rotation and the rotational angle to be detected/read for example through an input port of a suitably programmed microcontroller or configured digital state machine.

Both the electrical contacts 144/146 and the displaceable portion 16 may be made of virtually any electrically conducting material, such as metals or alloys, e.g. stainless steel, cupper alloys, such as CuBe, CuNi or CuZn, Paladium alloys, such as Paliney 6 or HERA 649. Respective surfaces of the displaceable portion 16 and/or the electrical contacts may be coated by noble metals, such as gold, silver or palladium.

The displaceable portion 16 preferably comprises a material with good spring or resilient properties and of suitable hardness. This material may be identical or different from that of the electrical contacts 144/146.

In a further embodiment, a further conductive element 18, illustrated in FIG. 2(*e*), may be provided. This conductive element 18 may engage the displaceable portion 16, if the first part 12 is movable in a direction toward the base 14. Thus, displacement in the axial direction of the first part 12 may, in addition to the rotation of the latter part, be sensed.

The forcing of the displaceable portion 16 toward the element 18 may be performed by projections 123 or by valleys 124, depending on the rotational position of the first and second parts when pressing the first part 12 downwards.

In order to interconnect the pulse generator 10 to the external world such as a PCB or similar carrier of a portable terminal or hearing instrument, a set of externally accessible terminals or pads 20 are provided on the lower side of the base 14. Respective ones of these externally accessible terminals 20 are electrically connected to the displaceable portion 16, the electrical contacts 144 and 146, and optionally to conductor 18.

These externally accessible pads 20 may be provided as respective unitary portions of the displaceable portion 16 and the electrical contacts 144, 146, thereby reducing the number of separate parts of the pulse generator 10.

Figure 3:
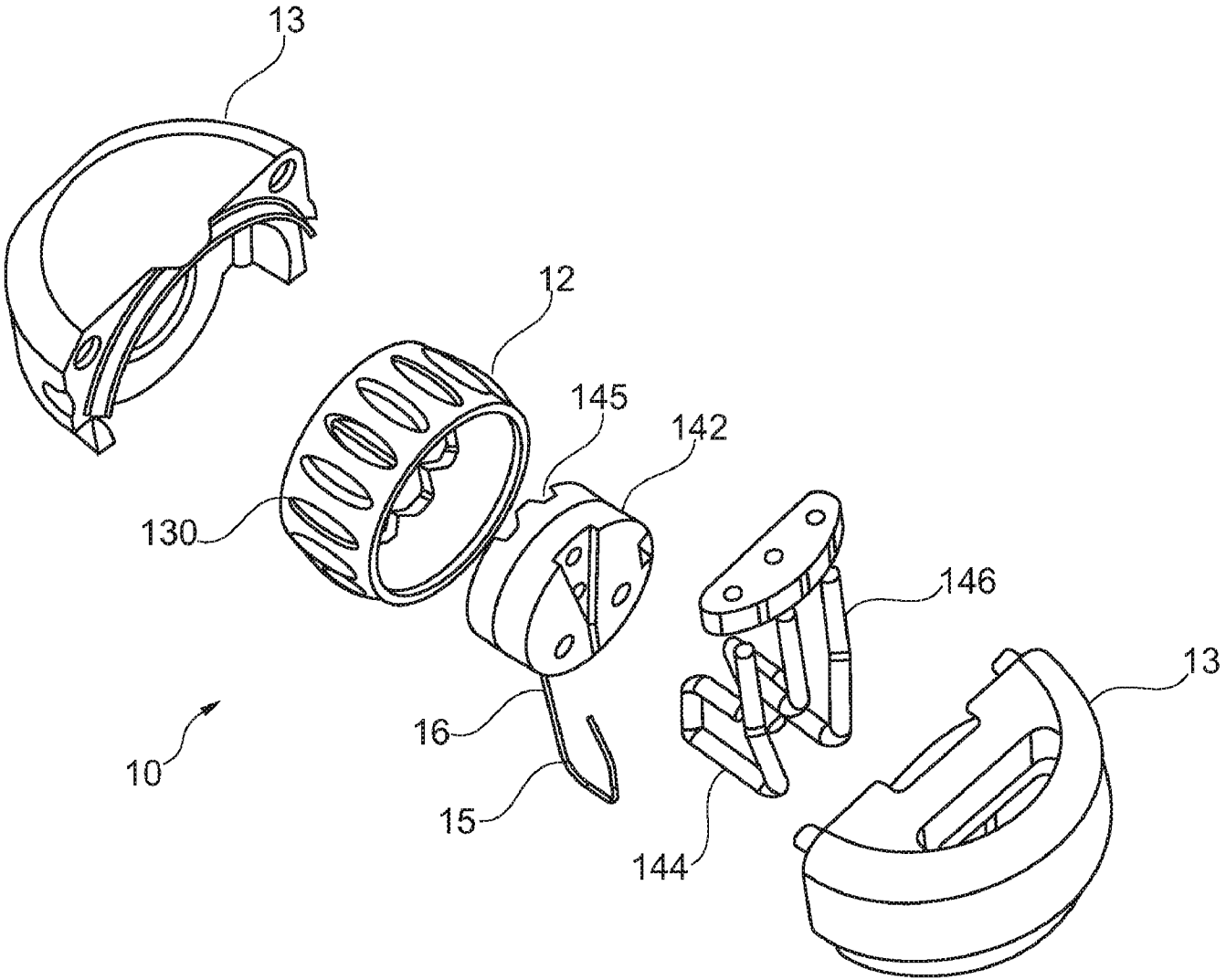
FIG. 3 is an exploded view of a second embodiment of an electromechanical pulse generator in accordance with the invention.

FIG. 3 is an exploded view of a second embodiment of an electromechanical pulse generator 10 according to the invention. The design style of this pulse generator is often referred to as "roller key" or simply "roller". Components of this embodiment that have similar functions to components of the pulse generator discussed in connection with FIG. 1 have been provided with identical reference numbers to ease comparison and understanding.

The first part 12 is provided as a unitary element, preferably an injection molded thermoplastic item, which provides the functionality of the actuatable knob 121, element 122 and intermediate members 125, 126 of the pulse generator of FIG. 1. A corrugated surface 130 of the first part 12 extends to the outside of mating housing portions 13 allowing the user to touch and actuate the pulse generator 10. The orientation of the corrugated surface 130 and shape and size of the first element 12 relative to the mating housing portions 13 allows the user to manipulate the first part 12 in transversal orientation relative to the axial direction of the pulse generator 10 through the centre of base 142 and first part 12. This actuation orientation is different from the one applied in pulse generator according to the first embodiment of the invention (FIG. 1) where the actuation orientation of the knob 121 is axially.

The base element 142 also comprises a protrusion 145 arranged proximally to an outer peripheral surface of the (cylindrical or disc shaped) base 142 and between the electrical contacts 144 and 146. The protrusion 145 in this embodiment of the invention has the same function as the corresponding protrusion on the base of the pulse generator described in detail in connection with FIGS. 1 and 2.

While the present invention has been described with reference to one or more particular embodiments, those skilled in the art will recognize that many changes may be made thereto without departing from the spirit and scope of the present invention. Each of these embodiments and obvious variations thereof is contemplated as falling within the scope of the claimed invention, which is set forth in the following claims.

The invention claimed is:

1. An electromechanical pulse generator, comprising:

a base and a first part, the first part being rotatably mounted relative to the base around an axis of rotation, the first part comprises a surface with a predetermined number of projections extending toward the base, each projection having a top, and wherein valleys existing between neighboring projections, the base comprises an electrical conductor having a displaceable resilient contact portion and two electrical contacts having a predetermined distance there between, the displaceable resilient contact portion being biased toward the surface of the first part, the electrical contacts extending, along the axis of rotation, at least from a first position occupied by the resilient contact portion when engaging a valley between two neighboring projections and to a second position occupied by the resilient contact portion when engaging a top of a projection, and wherein the base comprises a protrusion arranged to contact the displaceable resilient contact portion to prevent rebound thereof.

2. An electromechanical pulse generator according to claim 1, wherein the protrusion is arranged proximally to an outer peripheral surface of the base.

3. An electromechanical pulse generator according to claim 1, wherein the protrusion protrudes from a bottom surface of a pie piece or circle sector cut-out of the base.

4. An electromechanical pulse generator according to claim 1, wherein the protrusion comprises a pair of inclined surfaces arranged to slidingly engage with the displaceable resilient contact portion.

5. An electromechanical pulse generator according to claim 1, wherein a distance, along the axis of rotation, between the top of a projection and a top of the protrusion is smaller than a cross-sectional dimension, such as a diameter, of the resilient displaceable contact portion.

6. An electromechanical pulse generator according to claim 1, wherein the projections on the first part are radially-oriented and form a circular pattern around the axis of rotation.

7. An electromechanical pulse generator according to claim 1, wherein the first part is displaceable along the axis of rotation toward the base, the base comprising a third electrical contact positioned, in a plane of the rotational movement, between the two electrical contacts and, along the perpendicular direction, at a third position being further along the perpendicular direction than the second projection.

8. An electromechanical pulse generator according to claim 7, wherein the third electrical contact is positioned so as to not be activated during normal rotation.

9. An electromechanical pulse generator according to claim 1, wherein the projections are positioned along a predetermined curve in a plane of the rotatable movement, and wherein a part of the electrical conductor is fixed in, or to, the base, the displaceable resilient contact portion extending, in the plane, from inside the curve to outside thereof.

10. An electromechanical pulse generator according to claim 9, wherein the electrical conductor comprises a U-shaped section with one leg is fixed to the base and the other leg comprises the displaceable resilient contact portion.

11. A hearing aid or personal communication device comprising an electromechanical pulse generator according to claim 1.

12. A method of providing electrical pulses by actuating an electro-mechanical pulse generator, the method comprising:

(a) providing a first part rotatable in relation to a base around an axis of rotation, the first part being adapted to be user operable and having a surface comprising a number of projections each having a top, (b) providing, in engagement with the base, an electrical conductor having a displaceable resilient contact portion biased toward a surface of the first part, (c) providing, in engagement with the base, two electrical contacts positioned, in the plane of rotation, on opposing sides and adjacent to the displaceable resilient contact portion, (d) rotating the first part in relation to the base in a predetermined direction of rotation so that the displaceable resilient contact portion engages a projection and is displaced, substantially in a plane of the rotation, until the resilient contact portion engages one of the electrical contact(s), (e) after step (d), sliding the displaceable resilient contact portion along a surface of the projection and a surface of the electrical contact, at an angle to the plane of rotation, until the displaceable resilient contact portion reaches the top of the projection, (f) disengaging the contact between the electrical contact and the displaceable resilient contact portion by further rotation of the first part in the predetermined direction of rotation, (g) contacting and preventing movement of the displaceable resilient contact portion in a direction opposite to the predetermined direction of rotation by a protrusion arranged on the base to prevent rebound of the displaceable resilient contact portion, (h) repeating steps (d) through (g) one or more times.

* * * * *

UNITED STATES PATENT AND TRADEMARK OFFICE

CERTIFICATE OF CORRECTION

PATENT NO. : 8,101,876 B2
APPLICATION NO. : 12/427371
DATED : January 24, 2012
INVENTOR(S) : Jorgen Andreasen et al.

It is certified that error appears in the above-identified patent and that said Letters Patent is hereby corrected as shown below:

On the title page item (73), In the Assignee:

Please delete "Sonion APS, Roskilde (DK)" and

Please insert -- Sonion A/S, Roskilde (DK) --

Signed and Sealed this
Seventh Day of August, 2012

David J. Kappos

David J. Kappos
*Director of the United States Patent and Trademark Office*